US011650015B2

(12) United States Patent
Kang

(10) Patent No.: US 11,650,015 B2
(45) Date of Patent: May 16, 2023

(54) METHOD AND APPARATUS FOR THERMOSIPHON DEVICE

(71) Applicant: Aavid Thermalloy, LLC, Laconia, NH (US)

(72) Inventor: Sukhvinder S. Kang, Concord, NH (US)

(73) Assignee: Aavid Thermalloy, LLC, Laconia, NH (US)

( * ) Notice: Subject to any disclaimer, the term of this patent is extended or adjusted under 35 U.S.C. 154(b) by 2 days.

(21) Appl. No.: 17/396,898

(22) Filed: Aug. 9, 2021

(65) Prior Publication Data

US 2023/0039213 A1 Feb. 9, 2023

(51) Int. Cl.
*F28D 15/02* (2006.01)
*F28D 21/00* (2006.01)

(52) U.S. Cl.
CPC ..... *F28D 15/025* (2013.01); *F28D 15/0266* (2013.01); *F28D 2015/0216* (2013.01); *F28D 2021/0029* (2013.01)

(58) Field of Classification Search
CPC ..... F28D 15/025; F28D 15/0266; F28D 2015/0216; F28D 2021/0029; F28D 15/02; H05K 7/203; H05K 7/20327; H05K 7/20445; H05K 7/20672; H05K 7/20809; H05K 7/20818; H05K 7/20318
See application file for complete search history.

(56) References Cited

U.S. PATENT DOCUMENTS

| | | | | |
|---|---|---|---|---|
| 2007/0119568 | A1 | 5/2007 | Weber et al. | |
| 2013/0160975 | A1* | 6/2013 | Stautner | F28D 15/0266 165/104.22 |
| 2017/0363365 | A1 | 12/2017 | Aoki et al. | |
| 2018/0231326 | A1* | 8/2018 | Rice | F28D 15/0266 |
| 2020/0064074 | A1 | 2/2020 | Wan et al. | |

FOREIGN PATENT DOCUMENTS

| | | | |
|---|---|---|---|
| CN | 214536952 | U * | 10/2021 |
| EP | 2 332 839 | A1 | 6/2011 |
| JP | S59-094445 | A | 5/1984 |
| JP | S61-079773 | U | 5/1986 |
| JP | H03-023604 | U | 3/1991 |

OTHER PUBLICATIONS

International Search Report and Written Opinion for International Application No. PCT/US2022/039373, dated Nov. 8, 2022.

* cited by examiner

*Primary Examiner* — Harry E Arant
(74) *Attorney, Agent, or Firm* — Wolf, Greenfield & Sacks, P.C.

(57) ABSTRACT

A thermosiphon device includes an evaporator section, a condenser section and a liquid path configured to deliver liquid that exits the evaporator section directly back to the evaporator inlet. The condenser section has a significantly reduced mass flow rate and lower pressure drop as compared to the evaporator section, which has an increase liquid fraction of working fluid.

23 Claims, 3 Drawing Sheets

METHOD AND APPARATUS FOR THERMOSIPHON DEVICE

BACKGROUND OF THE INVENTION

1) Field of Invention

This invention relates generally to thermosiphon devices and other heat transfer devices that employ a two-phase fluid for cooling.

2) Description of Related Art

Thermosiphon devices are widely used for cooling systems, such as integrated circuits and other computer circuitry. For example, U.S. Patent Publication 2013/0104592 discloses a thermosiphon cooler used to cool electronic components located in a cabinet or other enclosure.

SUMMARY OF THE INVENTION

Thermosiphon devices are arranged to gather heat from hot or otherwise relatively warm regions through the vaporization of working fluid from the liquid to vapor phase in evaporator channels and to dissipate the heat at relatively cooler regions through condensation from the vapor back to the liquid phase in condenser channels. The flow of vaporized fluid from the evaporator to the condenser regions and that of liquid from the condenser back to the evaporator region results in a pressure drop because of friction between the fluid and the enclosing channels. Pressure head to overcome this pressure drop is typically provided by the action of gravity between the liquid level in the condenser and the liquid-vapor mixture in the evaporator. To improve the cooling performance of evaporators, it is desirable to increase the flow rate through the evaporator so that only a fraction of the liquid is vaporized and the fluid exits the evaporator with a low mass fraction of vapor or low vapor quality. To improve the cooling performance of the condenser, it is desirable to have mainly vapor at its inlet or high vapor quality near 1. The flow rate of fluid through existing thermosiphon coolers is a compromise between these two desirable limits. Inventive aspects aim to break this compromise and enable both the evaporator and condenser regions to operate at their most desirable conditions. This improvement can be implemented in one of several ways, e.g., by:

a. Increasing liquid flow circulation in the evaporator section, which enables liquid to be present along the full height of the evaporator so that electronics or other heat generating components that need to be cooled can be positioned even near the highest points in the thermosiphon;

b. Separation of the liquid and vapor phases at the exit of the evaporator so only the vapor fraction of the flow enters the condenser while liquid returns to the inlet of the evaporator through a dedicated liquid path;

c. Reducing fluid flow and correspondingly enabling a lower pressure drop in the condenser channels, which enables greater pressure head to be available to drive fluid circulation in the evaporator even when the thermosiphon is inclined; and d. Enabling the thermosiphon to function at higher levels of heat load.

Inventive aspects also enable the thermosiphon to function effectively over a wider range of inclinations including fully horizontal. A vertical orientation of the evaporator and condenser channels is often preferred because that produces the highest pressure head difference. However, some embodiments reduce the pressure drop through the condenser so that sufficient fluid flow can be maintained in the evaporator even when the pressure head difference is reduced when the thermosiphon is inclined away from the vertical orientation. This ability to function effectively in orientations ranging over 90 degrees of angle from vertical to fully horizontal is a highly desirable feature enabled in some embodiments.

One aspect of the invention provides a thermosiphon device having an evaporator section including an evaporator inlet configured to receive a liquid and an evaporator outlet, where the evaporator section is configured to receive heat and evaporate the liquid to form a vapor that is delivered from the evaporator outlet. A condenser section has a condenser inlet configured to receive vapor from the evaporator outlet and to transfer heat from the vapor to a surrounding environment to condense the vapor into condensed liquid. The condenser section also includes a condenser outlet to deliver the condensed liquid to the evaporator inlet. A liquid path is connected between the evaporator outlet and the evaporator inlet and between the condenser inlet and the condenser outlet and is configured to deliver liquid exiting the evaporator outlet to the evaporator inlet, e.g., so liquid does not enter the condenser inlet. For example, a separation chamber can be connected to the evaporator outlet and configured to separate liquid exiting the evaporator outlet from vapor exiting the evaporator outlet. The separation chamber can be connected to the liquid path to deliver the separated liquid to the liquid path, e.g., for return to the evaporator section inlet. The separation chamber can also be connected to the condenser inlet to deliver the separated vapor to the condenser section. This arrangement can allow the evaporator section to operate such that a relatively high fraction of liquid phase working fluid (or vapor having a low vapor quality) exits the evaporator outlet along with vapor phase working fluid. That is, since the liquid phase working fluid can be separated and returned to the evaporator inlet, the liquid will not enter the condenser section and disrupt its operation. Instead, the condenser section can receive high quality vapor at the condenser inlet and little to no liquid. Multiple benefits can be provided by this arrangement, including allowing the evaporator section to operate while largely or completely filled with liquid phase working fluid which improves heat transfer to the working fluid, increasing the liquid flow rate through the evaporator section and preventing liquid from entering the condenser inlet which can disrupt heat transfer from vapor in the condenser section and increase resistance to flow through the condenser section.

In some embodiments, the separation chamber and liquid path are configured such that the separation chamber is always drained of any liquid, e.g., any liquid in the separation chamber is received by the liquid path and carried away from the separation chamber. In some cases, the liquid path includes a trap at a lower end that is configured to hold liquid. The trap can include a U-shape with an open end positioned above a bottom of the U-shape. As discussed more below, the trap can help maintain suitable pressure at the condenser inlet and evaporator outlet to allow suitable flow through the thermosiphon.

In some embodiments, a delivery chamber is connected to the evaporator inlet, the condenser outlet and the liquid path. For example, the delivery chamber can be fluidly connected to the open end of a trap of the liquid path. Thus, the delivery chamber can hold liquid phase working fluid, e.g., that exits the liquid path and/or the condenser outlet, for delivery to the evaporator section. In some embodiments, the delivery chamber can hold liquid at a maximum level that is below an end of the liquid path, e.g., below the open end of a trap. In some embodiments, the delivery chamber holds liquid at a maximum level that is above the end of the liquid path, e.g., above an open end of a trap. A delivery chamber can be provided with the thermosiphon device, either with or without a separation chamber.

In some embodiments, the thermosiphon device is configured to operate such that a maximum liquid level in the delivery chamber is below a maximum liquid level in the condenser section and such that the maximum liquid level in the condenser section is below a maximum liquid level in the evaporator section.

In some embodiments, the thermosiphon device is configured to operate such that a mixture of vapor and liquid exit the evaporator outlet.

In some embodiments, the liquid path is configured to transfer heat from fluid in the liquid path to the surrounding environment at a lower rate than the condenser section.

In some embodiments, the evaporator section is configured to receive heat from a heat generating device at a location near the evaporator outlet.

In some embodiments, the evaporator section is configured to receive heat from a heat generating device at a heat receiving location above where the liquid path receives liquid for delivery to the evaporator inlet. For example, a separation chamber can be connected to the evaporator outlet and configured to separate liquid exiting the evaporator outlet from vapor exiting the evaporator outlet. The separation chamber can be connected to the liquid path at a location below the heat receiving location to deliver separated liquid to the liquid path and can be connected to the condenser inlet to deliver separated vapor to the condenser section.

In some embodiments, the thermosiphon device is configured to operate such that the condenser section has a pressure drop between the condenser inlet and the condenser outlet that is lower than a pressure drop between the evaporator inlet and the evaporator outlet.

In some embodiments, the thermosiphon device is configured to operate such that the condenser section has a mass flow rate of working fluid through the condenser section that is less than a mass flow rate of working fluid through the evaporator section. For example, the mass flow rate of working fluid through the condenser section is at least 2 times less than the mass flow rate of working fluid through the evaporator section.

In some embodiments, the evaporator section is configured to receive heat from a heat generating device at a heat receiving location above a liquid level in the condenser section.

These and other aspects of the invention will be apparent from the following description. Also, it should be appreciated that different aspects of the invention may be combined in a variety of different ways.

BRIEF DESCRIPTION OF THE DRAWINGS

The accompanying drawings, which are incorporated in and form a part of the specification, illustrate select embodiments of the present invention and, together with the description, serve to explain the principles of the inventions. In the drawings.

DETAILED DESCRIPTION

Figure 1:
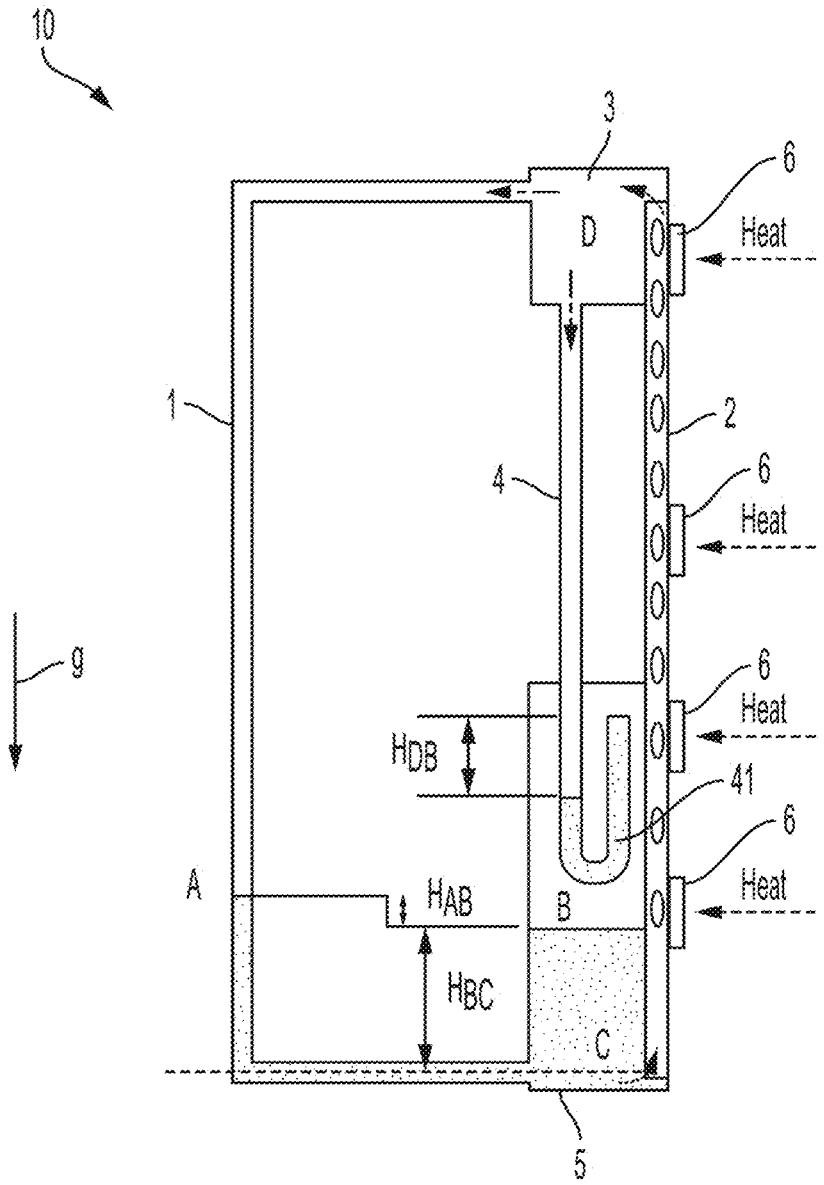
FIG. 1 is a schematic view of a thermosiphon device in an illustrative embodiment that incorporates aspects of the invention.

Aspects of the invention are not limited in application to the details of construction and the arrangement of components set forth in the following description or illustrated in the drawings. Other embodiments may be employed and aspects of the invention may be practiced or be carried out in various ways. Also, aspects of the invention may be used alone or in any suitable combination with each other. Thus, the phraseology and terminology used herein is for the purpose of description and should not be regarded as limiting.

FIG. 1 shows an illustrative embodiment of a thermosiphon device 10, e.g., used to cool electronics devices and/or other heat generating devices 6. Such heat generating devices 6 can be located in a closed cabinet or other enclosure, e.g., isolated from an environment outside of the enclosure to protect the devices 6 from dirt, humidity, moisture or other conditions. One or more portions of the thermosiphon device 10 can be located outside of the enclosure, or the entire thermosiphon device 10 can be located inside of the enclosure. For example, one or more evaporator sections 2 of the device 10 may be positioned in a sealed enclosure along with electronics or other heat-generating devices 6 to be cooled. One or more condenser sections 1 of the device 10 may be positioned outside of the enclosure and dissipate heat received from the evaporator section 2, e.g., to air in an environment outside of the enclosure. A flange on a portion of the device 10 (e.g., between the condenser and evaporator sections 1, 2) may be engaged with an opening of the enclosure, thereby sealing the enclosure and defining a dividing point between portions inside of the enclosure and an environment outside of the enclosure. By providing the evaporator section 2 inside the enclosure and the condenser section 1 outside of the enclosure, devices in the enclosure may be cooled while being contained in an environment protected from external conditions, e.g., protected from dirt, dust, contaminants, moisture, etc. Of course, use of a thermosiphon device with a sealed enclosure is not required, e.g., the device may be used in a completely open system in which heat generating devices 6 to be cooled are thermally coupled to the evaporator section 2 of the device 10 and exposed to environmental conditions around the device 10. Also, the embodiment of FIG. 1 shows the thermosiphon device 10 arranged vertically (e.g., with the evaporator section 2 oriented along the vertical or along local gravitational field lines g), but as described more below, the device 10 may be oriented in different ways, e.g., at one or more angles to the vertical and/or horizontal.

In simplified form, the thermosiphon device 10 operates to cool heat generating devices 6 by receiving heat at the evaporator section 2 such that liquid in evaporation channels of the evaporator section 2 boils or otherwise vaporizes. (The evaporator section 2 can include one or more evaporator channels, e.g., one or more tubes or other flow conduits, that receive heat to vaporize working fluid liquid in the evaporator channels.) Heat may be received at the evaporation section 2 by warm air (heated by the heat generating devices 6) flowing across a thermal transfer structure (e.g., fins, pins, etc.) that is thermally coupled to the evaporation section 2 (e.g., fins can be connected to one or more evaporation channels) and/or in other ways, such as by a direct conductive path between the devices 6 and the evaporator section 2, one or more heat pipes, a liquid heat exchanger, etc. As an example, a heat generating device 6 can directly contact evaporation channels or other parts of the evaporator section 2 to transfer heat by conduction and/or convection and/or radiation. Vapor flows upwardly in the evaporator section 2 upward against the force of gravity g because the vapor is lighter than the liquid phase working fluid and exits from an outlet of the evaporator section 2 into a separation chamber 3. However, in some cases, the vapor quality of the vapor exiting into the separation chamber 3 is typically low, i.e., the fluid exiting into the separation chamber 3 includes substantial quantities of liquid phase working fluid. In some embodiments, the device 10 is configured so that both working fluid vapor and liquid exit the evaporator outlet into the separation chamber 3. This type of operation can improve the cooling capability of the device 10, e.g., because the evaporator section 2 can be mostly flooded with liquid to receive heat from the heat generating devices 6. That is, by arranging the device 10 so that substantial amounts of liquid phase working fluid exits into the separation chamber 3 along with vapor phase working fluid, the evaporator section 2 can have a significant fraction of the working fluid in the evaporator section 2, including portions very near the exit to the separation chamber 3, be in liquid form, which aids in heat transfer to the working fluid.

While having a substantial amount of liquid along with vapor exit the evaporator section 2 improves operation of the evaporator section 2, having liquid enter the condenser section 1 can impede the efficient operation of the condenser section 1. For example, liquid in the condenser section 1 can slow the condensing process by impeding heat transfer from the vapor and increase the pressure drop across the condenser section 1 because of the increased friction of excess liquid flow through the section 1. To improve operation of the condenser section 1, the separation chamber 3 functions to separate working fluid vapor and liquid so that vapor is directed to the condenser section 1 and liquid is directed to a liquid path 4. In this way, only or primarily vapor enters the condenser section 1 inlet (e.g., the vapor quality of working fluid entering the condenser section 1 can be relatively high), which reduces the pressure drop across the condenser section 1 and improves the condensing efficiency of the condenser section 1. Liquid can be directed from the separation chamber 3 back to the evaporator section 2 inlet by the liquid path 4 for circulation through the evaporator section 2 again. The liquid path 4 can be separate from or independent of the evaporator section 2, e.g., include a tube or conduit that is physically separate from the evaporator section 2. The liquid path 4 can be configured to transfer heat from devices 6 to any working fluid in the liquid path 4 at a slower, and in some cases significantly slower, rate than the evaporator section 2. For example, the liquid path 4 can be configured so that liquid in the liquid path 4 is not evaporated while in the liquid path 4. Thus, flow of fluid in the liquid path 4 can be in one direction only. This can help avoid any disruption in liquid flow through the liquid path 4. In some embodiments, the liquid path 4 is configured to transfer heat from fluid in the liquid path to the surrounding environment at a lower rate than the condenser section, e.g., so that any vapor in the liquid path 4 is not condensed or condensed at a very slow rate. This can aid in avoiding disruption of vapor flow through the condenser section 1. In some embodiments, the separation chamber 3 and liquid path 4 are configured so that the separation chamber 3 is empty (or always emptied) of any liquid by the liquid path 4. Thus, in some embodiments, the separation chamber 3 will not have a liquid level or collection of liquid in the chamber 3 because the liquid path 4 drains the liquid from the separation chamber 3. This configuration can help improve the operation of the condenser section 1 because the condenser section 1 can receive entirely or at least mostly vapor and no liquid.

Vapor that enters the inlet of the condenser section 1 from the separation chamber 3 condenses to a liquid in the condenser section 1 and flows downwardly to a delivery chamber 5 that is coupled to the condenser section 1 outlet, the liquid path 4 outlet and the evaporator section 2 inlet. Heat removed from the vapor during condensation in the condenser section 1 may be transferred from the vapor to one or more condensing channels, e.g., one or more tubes or other flow channels. The condensing channels may transfer heat to heat transfer structure (e.g., fins, pins, other heat sink structure, etc.) coupled to the condensing channel, e.g., which increases the surface area of the condenser section 1 for heat transfer. Heat may be removed from the thermal transfer structure or other portions of the condenser section 1 by relatively cool air, by a liquid bath, a liquid heat exchanger, refrigerant coils, or other arrangement. Condensed liquid received at the delivery chamber 5 from the condenser section 1 enters an inlet to the evaporator section 2 and flows into one or more evaporation channels or other structure to receive heat, vaporize and repeat the process.

As noted above, an inventive feature includes the separation of working fluid liquid and vapor that exits from the evaporator section 2 so that separated liquid is directed by the liquid path 4 to the delivery chamber 5. This can provide at least two benefits. One, all of the working fluid (including both vapor and liquid) that exits from the evaporator section need not pass through the condenser section. This reduces the overall mass flow through the condenser section, which enables a smaller pressure drop through the condenser section and more efficient condensing of working fluid vapor. Two, the evaporator section can operate so that high amount or proportion of the working fluid that exits the evaporator section outlet is liquid. This enables the evaporator section to receive heat more efficiently and rapidly, e.g., because the evaporator section can be relatively flooded with liquid which receives heat more rapidly and in greater quantity per volume than vapor.

In some embodiments, the thermosiphon device can be configured to operate so working fluid flows only in a single direction along a continuous, closed loop during operation rather than include counterflow of working fluid in one or more portions of the device. For example, flow of working fluid in the condenser section may be in only one direction through the condenser section, i.e., vapor and condensed liquid flow in a same direction through the condenser section from inlet to outlet rather than having vapor and condensed liquid flow in opposite directions as in a counterflow-type operation. Similarly, liquid and vapor may flow in only one direction through the evaporator section, and liquid may flow in only one direction through the liquid path.

In some embodiments, the outlet of the evaporator section and/or an uppermost location where heat is received by the evaporator section from a heat generating device 6 can be positioned above a liquid level in the condenser section (e.g., level A in FIG. 1). This can aid in ensuing that liquid exiting the evaporator outlet is returned to the delivery chamber by the liquid path and proper separation of liquid and vapor exiting the evaporator outlet.

In some embodiments, the liquid path includes a trap at a lower end configured to hold liquid. Such a trap can assist in maintaining a desired pressure at the condenser section inlet to drive vapor flow through the condenser section. For example, FIG. 1 shows the liquid path 4 including a trap 41 at a lower end, e.g., that includes a U-shape with an open end positioned above a bottom of the U-shape. The trap 41 and open end of the liquid path 4 can be located within the delivery chamber 5 as shown in FIG. 1.

The trap 41 can help the device 10 maintain a desired pressure at the separation chamber 3, which can help drive flow of vapor through the condenser section 1. In the FIG. 1 embodiment, the pressure head available to drive vapor flow in the condenser section 1 is equal to the difference in liquid level between the open end of the trap 41 and the liquid in the trap less the difference in liquid level between the condenser section 1 and the delivery chamber 5 (i.e., levels A and B, respectively) or $H_{DA}=H_{DB}-H_{AB}$. On the other hand, the pressure head available to drive liquid flow through the evaporator section 2 is equal to the difference in liquid level between the delivery chamber 5 and the evaporator inlet (i.e., levels B and C, respectively) less the difference in liquid level between the open end of the trap 41 and the liquid in the trap or $H_{CD}=H_{BC}-H_{DB}$. Because only vapor flows through the condenser section 1, the required $H_{DB}$ is smaller than it would otherwise be so that a much larger head is available to circulate fluid through the evaporator section 2. This enables the evaporator section 2 to be better flooded with liquid, enhancing heat transfer. In some embodiments, the thermosiphon device is configured to operate such that the condenser section has a pressure drop between the condenser inlet and the condenser outlet that is lower than a pressure drop between the evaporator inlet and the evaporator outlet. This can be enabled, at least in part, by a reduced mass flow through the condenser section as compared to the evaporator section. In some cases, the mass flow rate through the evaporator section can be at least 2 times more, e.g., up to 10 times or more, than the mass flow rate through the condenser section. As will be understood, the reduced mass flow through the condenser section can enable the condenser section to be made to have a smaller cross sectional area, length or other size for flow through the condenser section than would otherwise be required, e.g., by employing smaller size tubes or other flow channels. This can reduce cost and weight. Also, because more of the pressure drop across the condenser section and liquid path is available to drive flow through the evaporator section, the evaporator section can be made to have a smaller cross sectional area, length or other size for flow through evaporator section.

Figure 2:
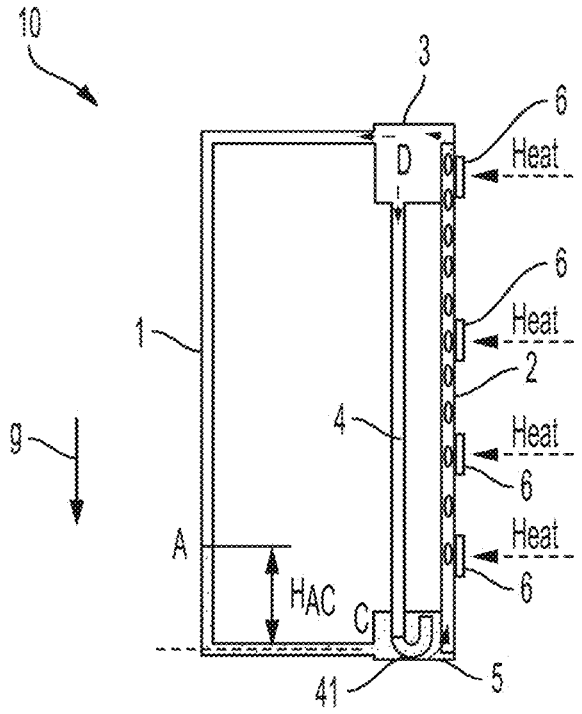
FIG. 2 is a schematic view of a modified version of the FIG. 1 embodiment in which an outlet end of the trap of the liquid path is positioned below a liquid level in a delivery chamber.
Figure 3:
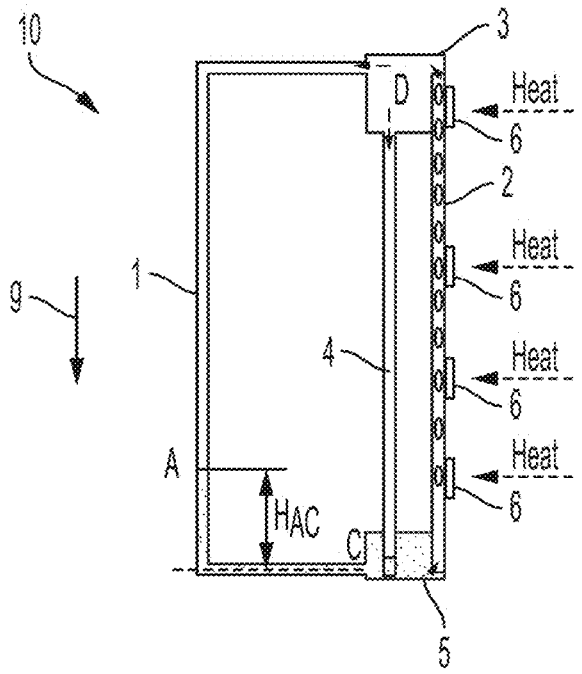
FIG. 3 is a schematic view of another modified version of the FIG. 1 embodiment in which the liquid path has no trap.

In some embodiments, the thermosiphon device is configured to operate such that a maximum liquid level in the delivery chamber (e.g., level B in FIG. 1) is below a maximum liquid level in the condenser section (e.g., level A) and such that the maximum liquid level in the condenser section is below a maximum liquid level in the evaporator section (e.g., which can be at or near the evaporator outlet). This is not typical of many thermosiphon devices, which have no liquid level in the condenser section because the condenser is typically elevated above the evaporator and is constantly drained of condensed liquid. In some embodiments, the evaporator section is configured to receive heat from a heat generating device at a heat receiving location above a liquid level in the condenser section, e.g., as can be seen in FIGS. 1-3. Again, this is not typical in thermosiphon devices, which generally have a heat receiving area positioned below the condenser section.

As noted above, the delivery chamber 5 is connected to the evaporator section inlet, the condenser section outlet, and the open end of the trap 41 of the liquid path 4. In some embodiments such as that shown in FIG. 1, the delivery chamber 5 holds liquid at a maximum level (level B) that is below the open end of the trap 41. In other embodiments such as that shown in FIG. 2, the delivery chamber 5 holds liquid at a maximum level that is above the open end of the trap 41. In some embodiments such as that shown in FIG. 3 the trap is formed when the liquid path 4 simply terminates in the delivery chamber 5 such that the open end of the liquid path is positioned below a liquid level in the delivery chamber 5. Configurations like that in FIGS. 2 and 3 can provide improved performance as compared to the FIG. 1 embodiment in situations where the thermosiphon device 10 may change orientations relative to the vertical, e.g., if the thermosiphon device 10 is installed on a vehicle such as a boat or airplane which can cause the device 10 to operate when positioned at different angles relative to the vertical.

Figure 4:
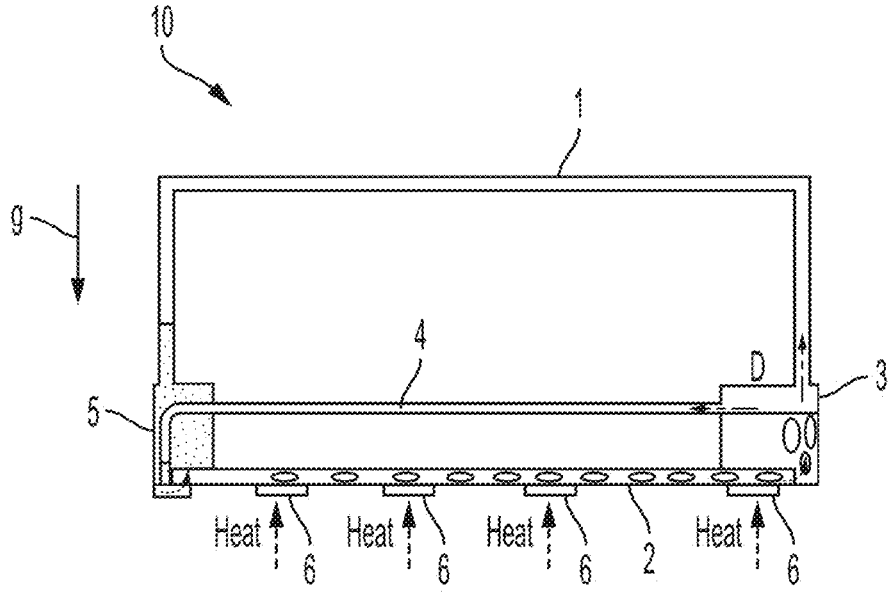
FIG. 4 is a schematic view of a thermosiphon device in which the evaporator section is oriented horizontally.
Figure 5:
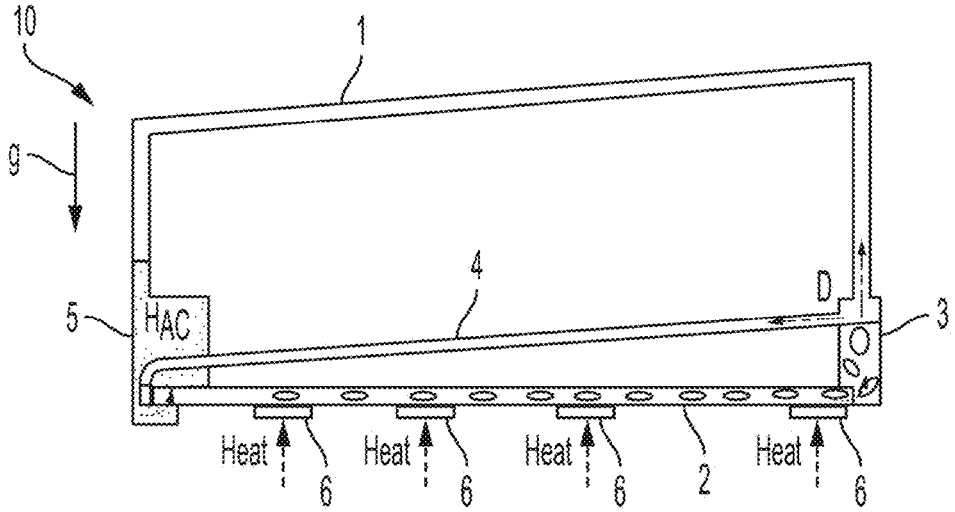
FIG. 5 is a schematic view of a modified version of the FIG. 5 embodiment in which the liquid path and/or condenser section are arranged at an angle relative to the horizontal direction.

The embodiments in FIGS. 2 and 3 can operate in a horizontal orientation, e.g., with the evaporator section 2 oriented parallel to the horizontal. FIGS. 4 and 5 show two alternate embodiments also configured to operate when in a horizontal orientation, including orientations within several degrees of horizontal. The embodiment in FIG. 4 is the same as that in FIGS. 1-3 except that the terminal end of the liquid path 4 at the delivery chamber 5 is configured to have an L-shaped bend so that the open end of the liquid path 4 is faces downwardly with the evaporator section 2 oriented horizontally. In this configuration, the separation chamber 3 is not always drained of liquid, but rather holds liquid that exits the evaporator section 2 at levels below the entrance to the liquid path 4 in the separation chamber 3. When the liquid level in the separation chamber 3 rises above that shown in FIG. 4, the liquid flows through the liquid path 4 to the delivery chamber 5. FIG. 5 shows a modified version of the FIG. 4 embodiment in which the liquid path 4 and/or the condenser section 1 are pitched at an angle relative to the horizontal when the evaporator section 2 is oriented horizontally. This arrangement can help make the thermosiphon device 10 maintain proper operation even when the device 10 is tilted adversely relative to the horizontal by several degrees or more, e.g., because condensed liquid flow in the condenser section 1 and/or liquid flow in the liquid path 4 can continue. This can help compensate for misalignment relative to gravity g when the device 10 is installed and/or due to movement of a support for the device 10 after installation.

The embodiments provided herein are not intended to be exhaustive or to limit the invention to a precise form disclosed, and many modifications and variations are possible in light of the above teachings. The embodiments were chosen and described in order to best explain the principles of the invention and its practical application to thereby enable others skilled in the art to best utilize the invention in various embodiments and with various modifications as are suited to the particular use contemplated. Although the above description contains many specifications, these should not be construed as limitations on the scope of the invention, but rather as an exemplification of alternative embodiments thereof.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified.

The use of "including," "comprising," "having," "containing," "involving," and/or variations thereof herein, is meant to encompass the items listed thereafter and equivalents thereof as well as additional items.

It should also be understood that, unless clearly indicated to the contrary, in any methods claimed herein that include more than one step or act, the order of the steps or acts of the method is not necessarily limited to the order in which the steps or acts of the method are recited.

While aspects of the invention have been described with reference to various illustrative embodiments, such aspects are not limited to the embodiments described. Thus, it is evident that many alternatives, modifications, and variations of the embodiments described will be apparent to those skilled in the art. Accordingly, embodiments as set forth herein are intended to be illustrative, not limiting. Various changes may be made without departing from the spirit of aspects of the invention.

The invention claimed is:

1. A thermosiphon device including:

an evaporator section including an evaporator inlet configured to receive a liquid and an evaporator outlet, the evaporator section configured to receive heat and evaporate the liquid to form a vapor that is delivered from the evaporator outlet;

a condenser section having a condenser inlet configured to receive vapor from the evaporator outlet and to transfer heat from the vapor to a surrounding environment to condense the vapor into condensed liquid, the condenser section including a condenser outlet to deliver the condensed liquid to the evaporator inlet; and a liquid path connected between the evaporator outlet and the evaporator inlet and between the condenser inlet and the condenser outlet, the liquid path configured to deliver liquid exiting the evaporator outlet to the evaporator inlet, wherein the thermosiphon device is configured to operate with a liquid level in the liquid path located below an uppermost portion of the liquid path.

2. The thermosiphon device of claim 1, comprising:

a separation chamber connected to the evaporator outlet and configured to separate liquid exiting the evaporator outlet from vapor exiting the evaporator outlet, the separation chamber being connected to the liquid path to deliver separated liquid to the liquid path and connected to the condenser inlet to deliver separated vapor to the condenser section.

3. The thermosiphon device of claim 2, wherein the separation chamber and liquid path are configured such that the separation chamber is always drained and empty of any liquid.

4. The thermosiphon device of claim 1, wherein the liquid path includes a trap at a lower end configured to hold liquid.

5. The thermosiphon device of claim 4, wherein the trap includes a U-shape with an open end positioned above a bottom of the U-shape.

6. The thermosiphon device of claim 5, comprising:

a delivery chamber connected to the evaporator inlet, the condenser outlet and the open end of the trap of the liquid path.

7. The thermosiphon device of claim 6, wherein the delivery chamber holds liquid at a maximum level that is below the open end of the trap.

8. The thermosiphon device of claim 6, wherein the delivery chamber holds liquid at a maximum level that is above the open end of the trap.

9. The thermosiphon device of claim 1, comprising:

a delivery chamber connected to the evaporator inlet, the condenser outlet and the liquid path to receive liquid from the condenser outlet and the liquid path and to deliver the liquid to the evaporator inlet.

10. The thermosiphon device of claim 9, wherein the liquid path has an open end that is positioned below a liquid level in the delivery chamber.

11. The thermosiphon device of claim 9, comprising:

a separation chamber connected to the evaporator outlet and configured to separate liquid exiting the evaporator outlet from vapor exiting the evaporator outlet, the separation chamber being connected to the liquid path to deliver separated liquid to the liquid path and connected to the condenser inlet to deliver separated vapor to the condenser section.

12. The thermosiphon device of claim 11, wherein the thermosiphon device is configured to operate such that a maximum liquid level in the delivery chamber is below a maximum liquid level in the condenser section and such that the maximum liquid level in the condenser section is below a maximum liquid level in the evaporator section.

13. The thermosiphon device of claim 12, wherein the thermosiphon device is configured to operate such that a mixture of vapor and liquid exit the evaporator outlet.

14. The thermosiphon device of claim 1, wherein the liquid path is configured to transfer heat from fluid in the liquid path to the surrounding environment at a lower rate than the condenser section.

15. The thermosiphon device of claim 1, wherein the evaporator section is configured to receive heat from a heat generating device at a location adjacent the evaporator outlet.

16. The thermosiphon device of claim 1, wherein the evaporator section is configured to receive heat from a heat generating device at a heat receiving location above where the liquid path receives liquid for delivery to the evaporator inlet.

17. The thermosiphon device of claim 16, comprising:

a separation chamber connected to the evaporator outlet and configured to separate liquid exiting the evaporator outlet from vapor exiting the evaporator outlet, the separation chamber being connected to the liquid path below the heat receiving location to deliver separated liquid to the liquid path and connected to the condenser inlet to deliver separated vapor to the condenser section.

18. The thermosiphon device of claim 1, wherein the thermosiphon device is configured to operate such that the condenser section has a pressure drop between the condenser inlet and the condenser outlet that is lower than a pressure drop between the evaporator inlet and the evaporator outlet.

19. The thermosiphon device of claim 1, wherein the thermosiphon device is configured to operate such that the condenser section has a mass flow rate of working fluid through the condenser section that is less than a mass flow rate of working fluid through the evaporator section.

20. The thermosiphon device of claim 19, wherein the mass flow rate of working fluid through the condenser section is at least 2 times less than the mass flow rate of working fluid through the evaporator section.

21. The thermosiphon of claim 1, wherein the evaporator section is configured to receive heat from a heat generating device at a heat receiving location above a liquid level in the condenser section.

22. The thermosiphon of claim 2, wherein the uppermost portion of the liquid path is located at a connection of the liquid path to the separation chamber.

23. The thermosiphon of claim 1, wherein the liquid level in the liquid path is located below the evaporator outlet.

* * * * *